US009463619B2

(12) United States Patent
Mitsuki

(10) Patent No.: US 9,463,619 B2
(45) Date of Patent: Oct. 11, 2016

(54) INKJET PRINTER AND IMAGE RECORDING METHOD

(75) Inventor: Kiyoomi Mitsuki, Kyoto (JP)

(73) Assignees: SCREEN HOLDINGS CO., LTD., Kyoto (JP); SEIKO EPSON CORPORATION, Tokyo (JP)

( * ) Notice: Subject to any disclaimer, the term of this patent is extended or adjusted under 35 U.S.C. 154(b) by 663 days.

(21) Appl. No.: 13/087,031

(22) Filed: Apr. 14, 2011

(65) Prior Publication Data

US 2011/0279500 A1 Nov. 17, 2011

(30) Foreign Application Priority Data

May 12, 2010 (JP) ..... 2010-110124

(51) Int. Cl.
*B41J 2/045* (2006.01)

(52) U.S. Cl.
CPC ..... *B41J 2/04573* (2013.01); *B41J 2/0456* (2013.01); *B41J 2/04558* (2013.01); *B41J 2/04581* (2013.01); *B41J 2/04588* (2013.01)

(58) Field of Classification Search
CPC ..... B41J 2/04581; B41J 2/04588; B41J 2/04541; B41J 2/0458; B41J 2202/20; B41J 2/2128; B41J 2/2132; B41J 2/14233; B41J 2/1623; B41J 2/03; B41J 2/02; B41J 2/04; B41J 2/04573; B41J 2/04558; B41J 2/0456; B41J 2/04516; B41J 2/04543; B41J 2/04561; B41J 2/04596; B41J 2/04598; B41J 2/0588; H04N 1/034
USPC ..... 347/10, 9, 11, 12, 13, 15, 68, 57, 74, 83
See application file for complete search history.

(56) References Cited

U.S. PATENT DOCUMENTS

| | | | | |
|---|---|---|---|---|
| 4,491,851 | A * | 1/1985 | Mizuno et al. | 347/11 |
| 4,686,539 | A * | 8/1987 | Schmidle et al. | 347/15 |
| 4,734,705 | A * | 3/1988 | Rezanka et al. | 347/75 |
| 5,461,406 | A * | 10/1995 | Lorenze et al. | 347/65 |
| 6,053,596 | A * | 4/2000 | Nakano et al. | 347/15 |
| 6,086,189 | A | 7/2000 | Hosono et al. | |

(Continued)

FOREIGN PATENT DOCUMENTS

| | | | |
|---|---|---|---|
| JP | 06-044393 | A | 2/1994 |
| JP | 06047914 | A * | 2/1994 |

(Continued)

OTHER PUBLICATIONS

Machine Translation for Misumi et al (JP Pat 10193649 A).*

*Primary Examiner* — Julian Huffman
*Assistant Examiner* — Sharon A Polk
(74) *Attorney, Agent, or Firm* — McDermott Will & Emery LLP

(57) ABSTRACT

In a head part of inkjet printer, a leading droplet and a following droplet are ejected from an outlet by inputting one driving signal, and the leading droplet and the following droplet land onto a recording paper. At this time, a waveform of the driving signal is set such that an average of distance from the center of a main dot element formed by the leading droplet to the farthest point in a group of dot elements formed by the leading droplet and the following droplet is equal to or more than 1.1 times an average of radius of the main dot element and equal to or less than 3.0 times the average. Therefore, the dot shape can be made noncircular, and as the result, it is possible to suppress jaggies on edges of an image on the recording paper and lowering of density in a solid area.

6 Claims, 8 Drawing Sheets

(56) References Cited

U.S. PATENT DOCUMENTS 6,283,568 B1 * 9/2001 Horii et al. ..... 347/10
6,293,644 B1 * 9/2001 Markham et al. ..... 347/19
6,302,508 B1 * 10/2001 Asauchi ..... B41J 2/2135 347/15
6,328,395 B1 * 12/2001 Kitahara ..... B41J 2/04541 347/15
6,331,040 B1 * 12/2001 Yonekubo ..... G06K 15/102 347/15
6,352,335 B1 * 3/2002 Koyama et al. ..... 347/37
6,354,686 B1 * 3/2002 Tanaka et al. ..... 347/11
6,406,116 B1 6/2002 Katakura et al.
6,488,349 B1 * 12/2002 Matsuo ..... B41J 2/04581 347/11
6,488,350 B2 * 12/2002 Iwasaki et al. ..... 347/12
6,494,554 B1 * 12/2002 Horii et al. ..... 347/10
6,527,354 B2 * 3/2003 Takahashi ..... 347/9
6,663,208 B2 * 12/2003 Suzuki et al. ..... 347/10
6,685,293 B2 * 2/2004 Junhua ..... 347/14
6,846,054 B2 * 1/2005 Ishinaga et al. ..... 347/5
7,073,878 B2 * 7/2006 Nishida et al. ..... 347/10
7,216,947 B2 * 5/2007 Kusunoki ..... 347/9
7,314,269 B2 * 1/2008 Kusunoki ..... 347/57
7,370,928 B2 * 5/2008 Hirakawa ..... 347/15
7,374,263 B2 * 5/2008 Hosono ..... 347/8
7,374,280 B2 * 5/2008 Kusunoki ..... 347/102
7,377,610 B2 * 5/2008 Hirakawa ..... 347/15
7,384,112 B2 * 6/2008 Hasegawa ..... 347/11
7,407,246 B2 * 8/2008 Vanhooydonck ..... B41J 2/0458 347/10
7,448,713 B2 * 11/2008 Sano et al. ..... 347/15
8,277,008 B2 * 10/2012 Tsukamoto ..... 347/10
2002/0057303 A1 5/2002 Takahashi et al.
2002/0135625 A1 * 9/2002 Iwasaki et al. ..... 347/9
2002/0186273 A1 * 12/2002 Nakagawa et al. ..... 347/37
2006/0268085 A1 * 11/2006 Konno ..... 347/100
2011/0050769 A1 * 3/2011 Tsukamoto ..... 347/10

FOREIGN PATENT DOCUMENTS

JP 07-285222 A 10/1995
JP 08-336970 12/1996
JP 10-193649 A 7/1998
JP 10193649 A * 7/1998
JP 2000-225718 A 8/2000
JP 2002-113860 4/2002
WO 00/53421 A1 9/2000

* cited by examiner

INKJET PRINTER AND IMAGE RECORDING METHOD

TECHNICAL FIELD

The present invention relates to an inkjet printer for recording an image on an object and an image recording method performed in an inkjet printer.

BACKGROUND ART

An inkjet printer is conventionally used, and in the inkjet printer, while a head part having a plurality of outlets is moved relative to an object, ejection of fine droplets of ink from each outlet is controlled to record an image. In the inkjet printer, for example, an ejection pulse is inputted to a piezoelectric element provided in the vicinity of each outlet in the head part to eject a droplet(s). In Japanese Patent Application Laid-Open No. 8-336970, disclosed is a technique where a plurality of ink droplets which are sequentially ejected at a constant frequency are merged during their flight to form a dot, since a driving signal is determined in consideration of Helmholtz frequency of a pressure generation chamber in a recording head. In Japanese Patent Application Laid-Open No. 2002-113860, disclosed is a technique where a landing position of a satellite ink droplet associated with a main ink droplet is aligned to a landing position of the main ink droplet, since a waveform of microdot driving pulse (ejection pulse) is set such that a flight speed of the satellite ink droplet is higher than a flight speed of the main ink droplet.

In the case where a plurality of droplets are merged during their flight or a landing position of satellite droplet is aligned to a landing position of main droplet, since a plurality of dots each having an almost circular shape are arranged regularly, there may be a case where an edge of an area represented by a group of dots becomes jagged (convexo-concave) or a density of an area to be represented by the maximum gray level (i.e., the area is a solid area of ink) becomes lower due to existence of gaps between dots. It is thought to suppress lowering of the density in the solid area by enlarging each dot by increasing an amount of ink included in a droplet. However, an outer edge of the area is swollen in this case.

SUMMARY OF INVENTION

The present invention is intended for an inkjet printer. It is an object of the present invention to suppress jaggies on edges of an image on an object and lowering of density in a solid area.

The inkjet printer according to the present invention comprises: a head part for ejecting droplets of ink from outlets toward an object; a scanning mechanism for moving the object in a predetermined scanning direction relative to the head part; and a controller for repeatedly inputting a driving signal to the head part in parallel with relative movement of the object to the head part, the driving signal being applied for ejection of droplet; wherein a leading droplet and a following droplet are ejected from an outlet by inputting the driving signal, and the leading droplet and the following droplet land onto the object, and an average distance from the center of a leading dot element formed on the object by the leading droplet to the farthest point in a group of dot elements formed on the object by the leading droplet and the following droplet is equal to or more than 1.1 times an average radius of the leading dot element and equal to or less than 3.0 times the average radius.

In the present invention, it is possible to suppress jaggies (unevenness) on edges of an image on the object and lowering of density in a solid area, since a shape of each dot formed by the plurality of droplets is made noncircular (non-circular).

According to a preferred embodiment of the present invention, by an ejection pulse included in the driving signal, the leading droplet which is a main droplet is ejected from the outlet and also the following droplet which is a satellite droplet(s) associated with the main droplet is ejected. Therefore, the dot shape can be made noncircular by the main droplet and the satellite droplet(s).

According to another preferred embodiment of the present invention, the leading droplet is ejected from the outlet by an ejection pulse included in the driving signal, and the following droplet is ejected from the outlet by the next ejection pulse in the driving signal. Therefore, the dot shape can be made noncircular by the droplets based on two continuous ejection pulses.

In this case, preferably, a main droplet and a satellite droplet(s) associated with the main droplet are ejected in at least one of ejection of the leading droplet and ejection of the following droplet, and an average distance from the center of a main dot element formed on the object by the main droplet to the farthest point in a group of dot elements formed on the object by the main droplet and the satellite droplet(s) is equal to or more than 1.1 times an average radius of the main dot element and equal to or less than 3.0 times the average radius.

According to an aspect of the present invention, a plurality of dots having different sizes can be formed on the object by ejecting droplets of ink from the outlet toward the object, the leading droplet and the following droplet are ejected from the outlet when a dot having the maximum size or a dot used for representing the maximum gray level area is formed.

According to another aspect of the present invention, another type of driving signal having a waveform different from the driving signal can be selectively inputted to the head part, and in the case where the another type of driving signal is inputted to the head part, the leading droplet and the following droplet are ejected from the outlet so that an average distance from the center of the leading dot element by the leading droplet to the farthest point in the group of dot elements by the leading droplet and the following droplet is less than 1.1 times an average radius of the leading dot element, or only one droplet is ejected from the outlet, or the average distance in the case of the another type of driving signal is different from the average distance in the case of the driving signal, while staying within a range which is equal to or more than 1.1 times an average radius of the leading dot element and equal to or less than 3.0 times the average radius.

As above, in the inkjet printer where the another type of driving signal can be selectively inputted to the head part, it is possible to select whether to change the dot shape or not, or to select a degree of change of the dot shape.

The present invention is also intended for an image recording method performed in an inkjet printer.

These and other objects, features, aspects and advantages of the present invention will become more apparent from the following detailed description of the present invention when taken in conjunction with the accompanying drawings.

DESCRIPTION OF EMBODIMENTS

Figure 1:
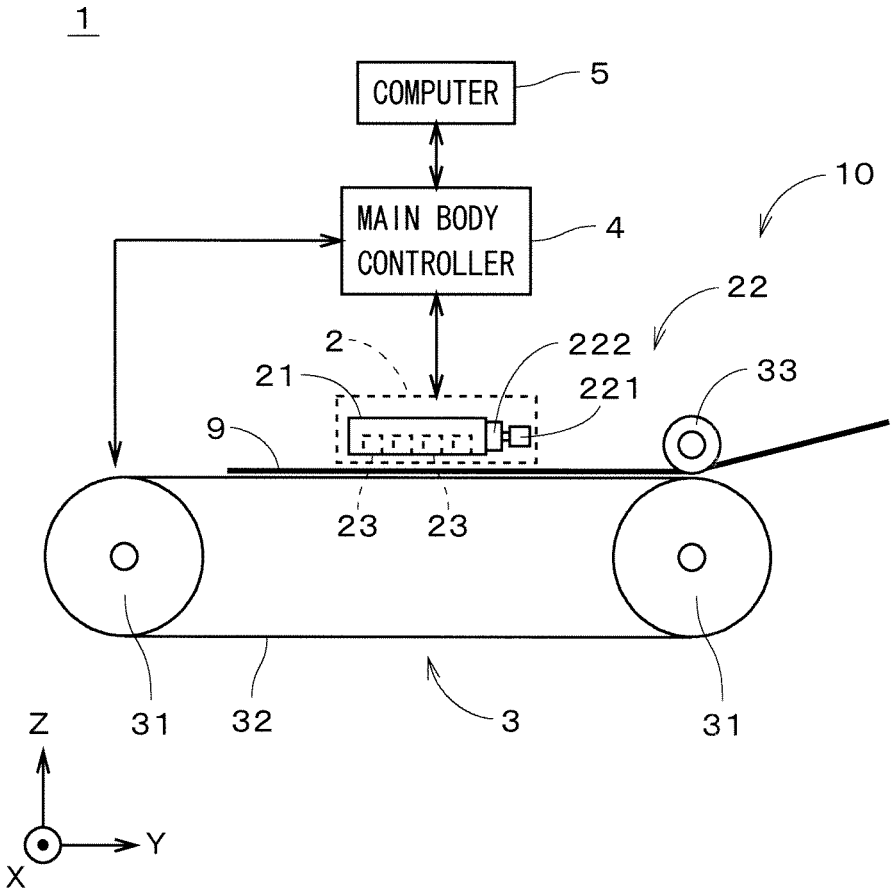
FIG. 1 is a view showing a constitution of an inkjet printer.

FIG. 1 is a view showing a constitution of an inkjet printer 1 in accordance with a preferred embodiment of the present invention. The inkjet printer 1 has a main body 10 and a computer 5 connected to the main body 10. The main body 10 has an ejection part 2 for ejecting fine droplets of ink toward a recording paper 9, a paper feeder 3 for moving the recording paper 9 toward the (−Y) direction in FIG. 1 at the lower side (the (−Z) side) of the ejection part 2, and a main body controller 4 connected to the ejection part 2 and the paper feeder 3.

The paper feeder 3 has two belt rollers 31 connected to a not-shown motor, and a belt 32 hanging between the two belt rollers 31. Each portion of the recording paper 9, which is continuous paper, is guided onto the belt 32 through a roller 33 provided above the belt roller 31 at the (+Y) side to be held thereon and it is moved toward the (−Y) side, passing under the ejection part 2 together with the belt 32. An encoder 34 (see FIG. 3) is provided to the belt roller 31 of the paper feeder 3. In the following description, the moving direction (the Y direction) of the ejection part 2 relative to the recording paper 9 is referred to as the scanning direction. The paper feeder 3 may have a construction where a suction part is provided at a position, which is opposite to the ejection part 2, inside the loop-like belt 32 and very small suction holes are formed on the belt 32, to hold the recording paper 9 on the belt 32 by suction.

A head unit 21 having a plurality of head parts 23 (in the preferred embodiment, four head parts 23) is provided to the ejection part 2. The plurality of head parts 23 can eject ink of C (cyan), M (magenta), Y (yellow) and K (black), respectively, and they are arranged in the Y direction.

Figure 2:
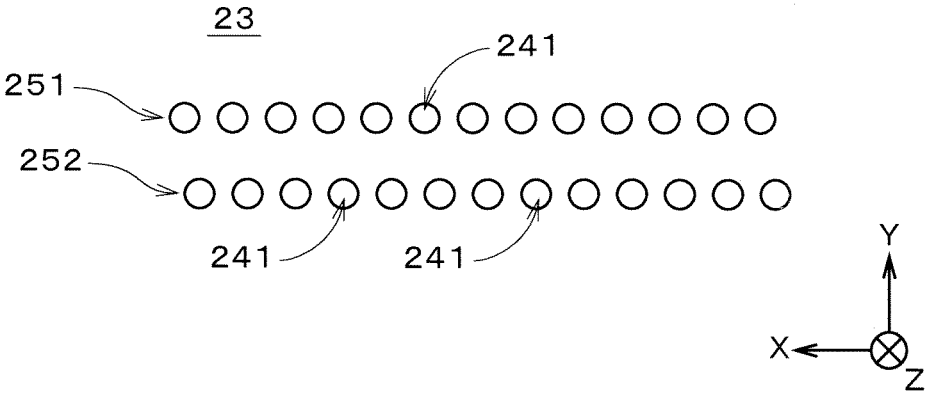
FIG. 2 is a bottom plan view of a head part.

FIG. 2 is a bottom plan view showing one head part 23, and in FIG. 2, the scanning direction of the recording paper 9 relative to the ejection part 2 (i.e., the Y direction) is shown as a vertical direction. A plurality of outlet rows 251, 252 (in the preferred embodiment, two rows) are provided on the bottom surface of each head part 23, and each outlet row 251, 252 has a plurality of outlets 241 arranged at a constant pitch in a direction orthogonal to the scanning direction and along the recording paper 9 (i.e., the direction is the X direction in FIG. 1 and corresponds to the width of the recording paper 9, and hereinafter the direction is referred to as the "width direction"). The plurality of outlet rows 251, 252 are arranged in the scanning direction. When focusing on only the width direction, a position of each outlet 241 in the outlet row 252 is slightly shifted relative to a correspondent outlet 241 in the outlet row 251, and one outlet 241 in the outlet row 252 is located between two adjacent outlets 241 in the outlet row 251.

Piezoelectric elements 232 (see FIG. 3) are provided for respective outlets 241 in the head part 23. By driving the piezoelectric elements 232, droplets of ink are ejected from the outlets 241 toward the recording paper 9. Actually, the plurality of outlets 241 are arranged across the entire width of an recording area of the recording paper 9 with respect to the width direction, and image recording can be accomplished in a short time by one time passage of the recording paper 9 under the ejection part 2 (i.e., by one pass) in the inkjet printer 1. Although the head part 23 where the plurality of outlet rows 251, 252 are formed as a unit is provided in the preferred embodiment, the head part 23 may be constructed by arranging head elements, in each of which one outlet row or a plurality of outlet rows are formed as a unit, in the X direction and the Y direction The ejection part 2 illustrated in FIG. 1 has a head moving mechanism 22 for moving the head unit 21 in the width direction. The head moving mechanism 22 includes a timing belt 222 which has a long circular shape in the width direction, and the motor 221 rotates the timing belt 222 to move the head unit 21 smoothly in the width direction. During a time when recording process is not performed in the inkjet printer 1, the head moving mechanism 22 places the head unit 21 in a preset home position, where the plurality of outlets 241 in each head part 23 are closed with a cover member, to thereby prevent the outlets 241 from being clogged with dry ink in the vicinity of the outlets 241.

Figure 3:
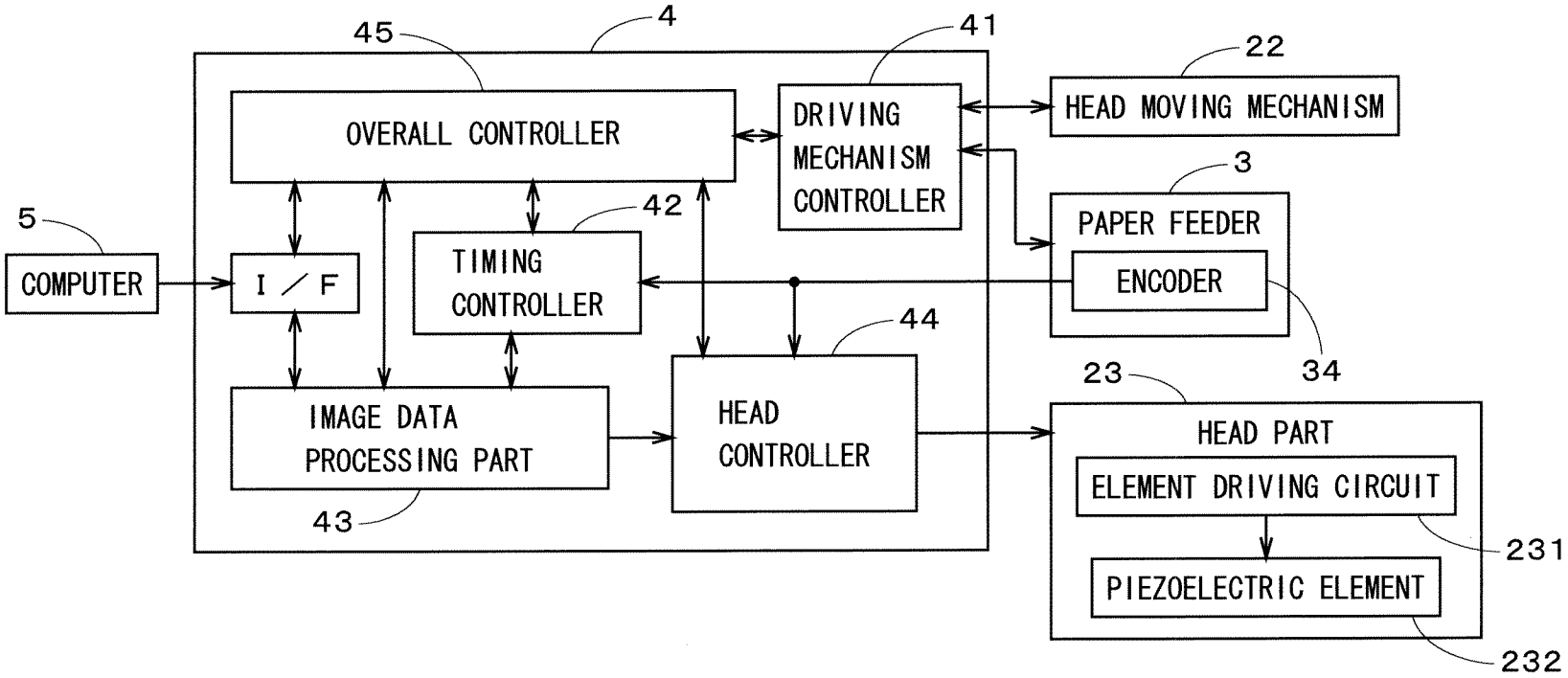
FIG. 3 is a block diagram showing a functional constitution of the inkjet printer.

FIG. 3 is a block diagram showing a functional constitution of the inkjet printer 1. The main body controller 4 has a driving mechanism controller 41 for performing driving control of the head moving mechanism 22 and the paper feeder 3, a timing controller 42 which receives an encoder signal from the encoder 34 of the paper feeder 3 and controls a timing for ejection of droplets from the outlets 241 of the head parts 23, an image data processing part 43 for generating writing data for the head parts 23 from an original image data which is inputted from the computer 5 via an interface (I/F) to be recorded, a head controller 44 which is connected to the head parts 23 and controls the head parts 23 on the basis of the writing data, and an overall controller 45 assigned to overall control of the main body controller 4. Additionally, although only one head part 23 is illustrated in FIG. 3 for the convenience of illustration, a signal is inputted to each of the plurality of head parts 23 from the head controller 44 in practice. The following description, which will be made about one head part 23 observed as an example, will hold true for all the head parts 23.

In the head part 23, an element driving circuit 231 is provided to the piezoelectric element 232 of each of the plurality of outlets 241, a value indicating whether to form a dot or not (the value is hereinafter referred to as the "output value") and a predetermined driving signal which is applied for ejection of droplet (i.e., the driving signal is intended to make an outlet eject a droplet) are repeatedly inputted to each element driving circuit 231 from the head controller 44 at a constant period (cycle). In FIG. 3, only one element driving circuit 231 and one piezoelectric element 232 are illustrated.

Figure 4:
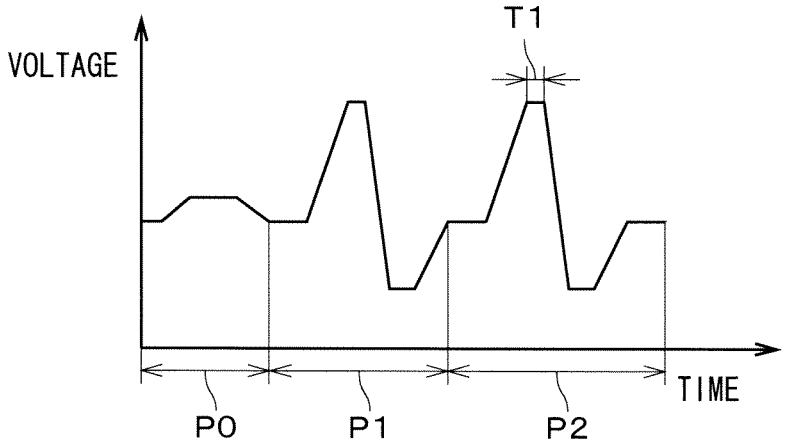
FIG. 4 is a view showing a driving signal.

FIG. 4 is a view showing the driving signal inputted to the head part 23 from the head controller 44. In FIG. 4, the vertical axis shows voltage and the horizontal axis shows time. The driving signal includes a plurality of pulses (in FIG. 4, three pulses). In FIG. 4, periods of the three pulses are indicated by arrows denoted by reference sings P0, P1, P2. Each pulse is intended for making the piezoelectric element 232 perform a series of operation. As described later, droplets are ejected from an outlet 241 by the pulses in the periods P1, P2, and a predetermined non-ejection operation is performed in the outlet 241 by the pulse in the period P0. Thus, in the following description, the pulses in the periods P1, P2 are referred to as the "first ejection pulse P1" and the "second ejection pulse P2", respectively, and the pulse in the period P0 is referred to as the "non-ejection pulse P0".

In each element driving circuit 231 of the head part 23, the non-ejection pulse P0 or the first and second ejection pulses P1, P2 are extracted from the driving signal in accordance with the output value from the head controller 44, and the pulse(s) is inputted to the piezoelectric element 232 corresponding to the element driving circuit 231. Specifically, in the element driving circuit 231 to which the output value indicating to form a dot is inputted, the first and second ejection pulses P1, P2 are extracted from the driving signal to be outputted to the correspondent piezoelectric element 232. Therefore, in the outlet 241 corresponding to the element driving circuit 231, droplet ejection operation (ejection operation of droplet) corresponding to the first ejection pulse P1 and droplet ejection operation corresponding to the second ejection pulse P2 are performed in rapid succession (continuously in a short time), to form a dot on the recording paper 9. In the element driving circuit 231 to which the output value indicating not to form any dot is inputted, only the non-ejection pulse P0 is extracted from the driving signal to be outputted to the correspondent piezoelectric element 232. Therefore, non-ejection operation (for example, micro-vibration at a level where any droplet is not ejected from the outlet 241) is performed in the outlet 241, and any dot is not formed on the recording paper 9.

As described later, in the inkjet printer 1, the output values and the driving signal are inputted to the head part 23 from the head controller 44 in synchronization with an ejection timing signal outputted from the timing controller 42. At this time, the output values and the driving signal are inputted to the element driving circuits 231 of the plurality of outlets 241 included in one outlet row 251 of FIG. 2 in response to one ejection timing signal, and the output values and the driving signal are inputted to the element driving circuits 231 of the plurality of outlets 241 included in the other outlet row 252 in response to the next ejection timing signal (i.e., an ejection timing signal just after the one ejection timing signal). In other words, writing operation (recording dots) is performed alternately by the plurality of outlets 241 included in one outlet row 251 and the plurality of outlets 241 included in the other outlet row 252, in the inkjet printer 1.

Figure 5:
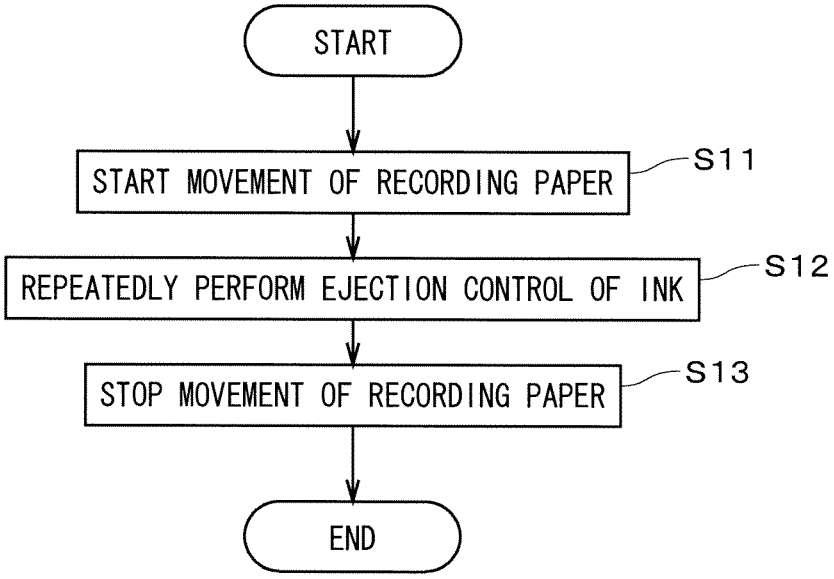
FIG. 5 is a flowchart showing an operation flow for recording an image.

FIG. 5 is a flowchart showing an operation flow for recording an image on the recording paper 9 by the inkjet printer 1. When image recording operation is started by the inkjet printer 1, first, the driving mechanism controller 41 drives the head moving mechanism 22, and thereby the head unit 21 in FIG. 1 is moved from the home position to a predetermined position in the X direction. Subsequently, the paper feeder 3 is driven to start movement of the recording paper 9 (Step S11), the head controller 44 in FIG. 3 sequentially inputs the output values and the driving signals to the head part 23 in parallel with relative movement of the recording paper 9 to the ejection part 2, and thereby ejection control of ink is repeatedly performed (Step S12).

In detail, every time when the recording paper 9 is moved by a predetermined distance in the scanning direction, an ejection timing signal is generated by the timing controller 42 on the basis of pulses outputted from the encoder 34. The output values and the driving signals are inputted to the plurality of element driving circuits 231 in the outlet row 251 and the plurality of element driving circuits 231 in the outlet row 252 alternately, from the head controller 44 in synchronization with the ejection timing signals. In this operation, in the outlet 241 where the output value indicating not to form any dot is inputted to its (correspondent) element driving circuit 231, only the non-ejection operation by the non-ejection pulse P0 is performed, and any dot is not formed on the recording paper 9. On the other hand, in the outlet 241 where the output value indicating to form a dot is inputted to its element driving circuit 231, the droplet ejection operation by the first ejection pulse P1 and the droplet ejection operation by the second ejection pulse P2 are performed in rapid succession (continuously in a short time), to form a dot on the recording paper 9.

Actually, in the droplet ejection operation by the first ejection pulse P1, a relatively large main droplet and a relatively small satellite droplet (hereinafter referred to as the "first main droplet" and the "first satellite droplet", respectively) are ejected from the outlet 241 almost simultaneously. In the droplet ejection operation by the second ejection pulse P2 following the first ejection pulse P1, a relatively large main droplet and a relatively small satellite droplet (hereinafter referred to as the "second main droplet" and the "second satellite droplet", respectively) are ejected from the outlet 241 almost simultaneously. In the present embodiment, ink which is ejected in a mist-like form and which doesn't form an after-mentioned dot element on the recording paper 9 is not included in "droplet".

Figure 6:
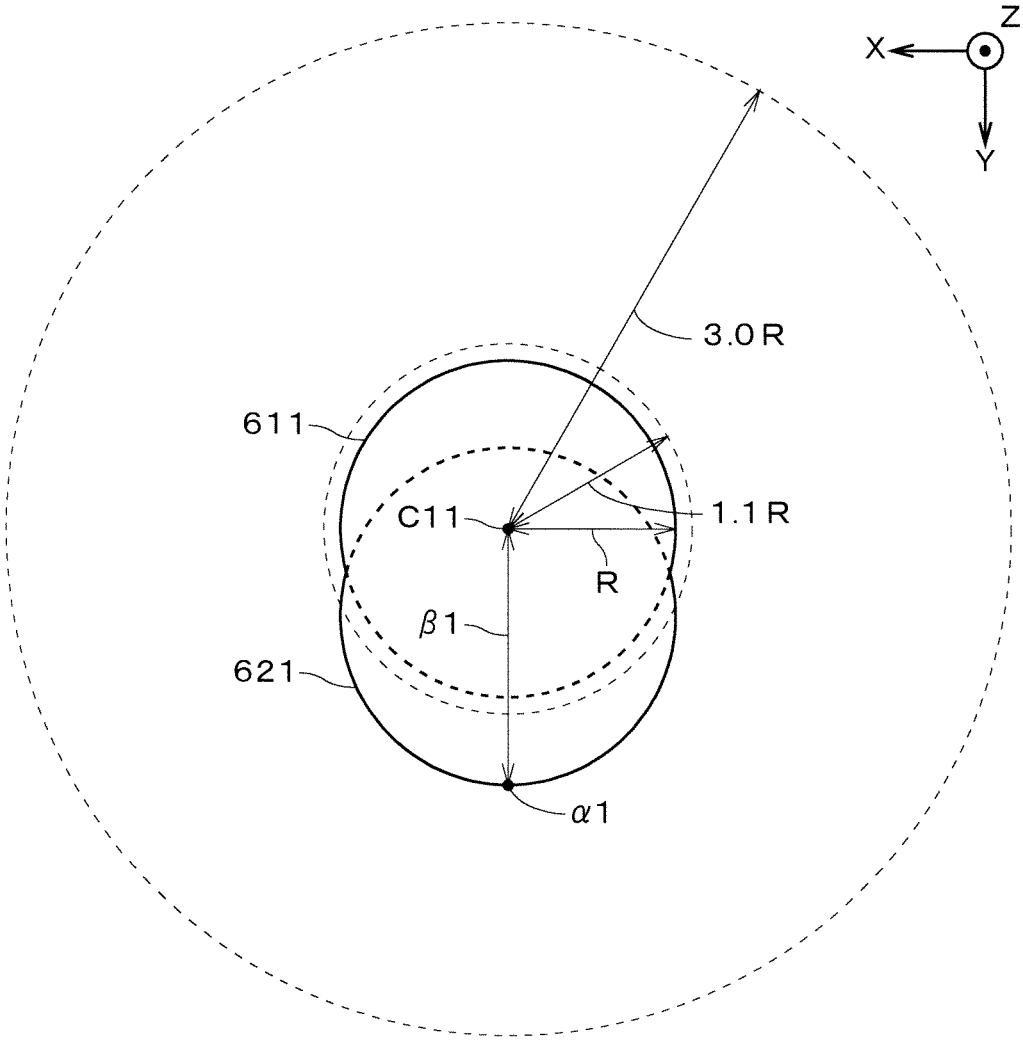
FIG. 6 is a view showing a first main dot element and a second main dot element.

FIG. 6 is a view showing an area on the recording paper 9 which a first main droplet and a second main droplet ejected by using the first ejection pulse P1 and the second ejection pulse P2 adhere to. The first main droplet lands onto the recording paper 9, thereby to form an area of ink as a first main dot element which is shown by a circle denoted by a reference sign 611 in FIG. 6 (i.e., the circle is represented by a solid line and a dashed line. The same applies to a circle 621 and a circle 622 in FIG. 7 mentioned later.). The second main droplet lands onto the recording paper 9, thereby to form an area of ink as a second main dot element which is shown by a circle denoted by a reference sign 621 in FIG. 6. The first main dot element 611 and the second main dot element 621 in FIG. 6 partially overlap with each other (i.e., on the recording paper 9, one area which one droplet adheres to is laid on the other area which the other droplet adheres to, in part). In fact, although an edge of each dot element is not clear in a portion where the dot elements overlap with each other, the edge is represented by a thick dashed line in FIG. 6 (the same applies to FIG. 7 described later). Since the outlet 241 has variations in an ejection direction within a certain extent and the like, a relative positional relationship between the center C11 of the first main dot element 611 and the center of the second main dot element 621 which lies at the (+Y) side of the center C11 is not constant in a precise sense.

When focusing on the main droplets in the droplet ejection operation by the first and second ejection pulses P1, P2, in the inkjet printer 1, shapes of the first and second ejection pulses P1, P2 in the driving signal are adjusted such that the first main droplet and the second main droplet are not merged during their flight and do not become a circular (spherical) shape on landing. In detail, when a set of the first and second main dot elements 611, 621 which is surrounded by a thick solid line in FIG. 6 is regarded as a group of dot elements, a waveform of driving signal is set such that an average of distance β1 (beta 1) from the center C11 of the first main dot element 611 to the farthest point al (alpha 1) in the group of dot elements (i.e., the average is an average distance in formation of all dots by all outlets 241. Hereinafter the same applies.) is almost 1.5 times an average of radius R of the first main dot element 611 (for example, equal to or more than 1.3 times the average radius and equal to or less than 1.7 times the average radius).

When determining the above waveform of driving signal, for example, in a waveform of a typical driving signal where two droplets ejected by two continuous ejection pulses can be merged during their flight (actually, a landing position of satellite droplet can be also aligned to a landing position of main droplet) in consideration of Helmholtz frequency (cycle), a period when a voltage of the second ejection pulse P2 remains at the maximum value (a time period denoted by a reference sign T1 in FIG. 4) is changed to a plurality of lengths, thereby to prepare a plurality of driving signals. While droplets are actually ejected from an outlet 241 by sequentially using the plurality of driving signals, video images of the droplets are captured by a high-speed camera to obtain flight speeds of the droplets and the like. Furthermore, states of dots formed on the recording paper 9 are checked (printing check). Therefore, determined is the waveform of driving signal where the average distance from the center C11 of the first main dot element 611 to the farthest point al in the group of dot elements becomes almost 1.5 times the average radius of the first main dot element 611. In practice, a definitive (final) waveform of driving signal is determined in additional consideration of relationship between landing positions of the first main droplet and the first satellite droplet and relationship between landing positions of the second main droplet and the second satellite droplet as described later. There may be a case where video images of states of flying droplets are captured while changing voltages of ejection pulses, a period between the pulses and the like, to determine the definitive driving signal.

Figure 7:
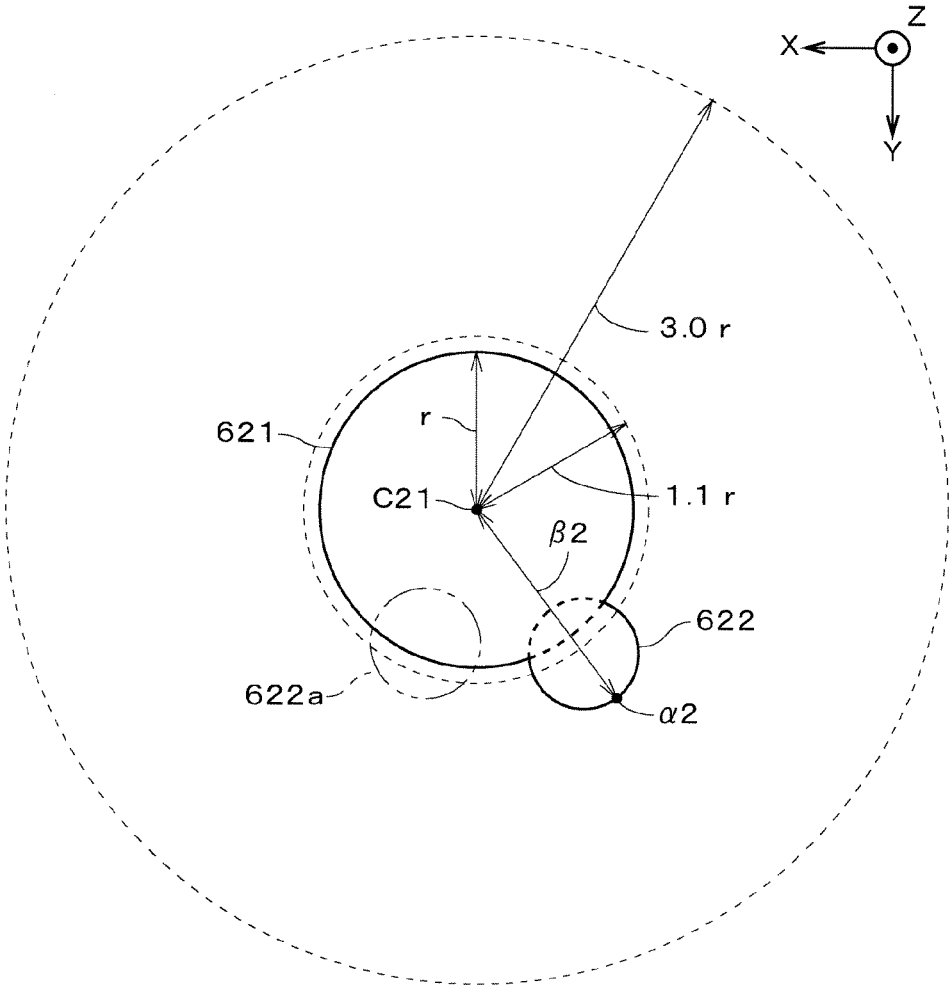
FIG. 7 is a view showing the second main dot element and a second satellite dot element.

FIG. 7 is a view showing an area on the recording paper 9 which the second main droplet and the second satellite droplet adhere to. In FIG. 7, a second main dot element is shown by a circle denoted by a reference sign 621 in the same way as FIG. 6. The second satellite droplet lands onto the recording paper 9, thereby to form an area of ink as a second satellite dot element which is shown by a circle denoted by a reference sign 622 in FIG. 7. A relative positional relationship between the center C21 of the second main dot element 621 and the center of the second satellite dot element 622 which lies at the (+Y) side of the center C21 is not constant, and the positional relationship actually varies to some extent.

When focusing on only the droplet ejection operation by the second ejection pulse P2, in the inkjet printer 1, a shape of the second ejection pulse P2 in the driving signal is adjusted such that the second main droplet and the second satellite droplet individually land onto the recording paper 9 and the second satellite dot element 622 lies in the vicinity of the outer edge of the second main dot element 621. In detail, when a set, which is surrounded by a thick solid line in FIG. 7, of the second main dot element 621 and the second satellite dot element 622 is regarded as a group of dot elements, a waveform of driving signal is set such that an average of distance β2 (beta 2) from the center C21 of the second main dot element 621 to the farthest point α2 (alpha 2) in the group of dot elements is almost 1.5 times an average of radius r of the second main dot element 621 (for example, equal to or more than 1.3 times the average radius and equal to or less than 1.7 times the average radius).

In the present embodiment, when a set of the first main dot element 611 and the first satellite dot element is regarded as a group of dot elements, the waveform of driving signal is set such that, in the droplet ejection operation by the first ejection pulse P1, an average distance from the center C11 of the first main dot element 611 to the farthest point in the group of dot elements is almost 1.5 times an average radius of the first main dot element 611 in a similar fashion to the ejection operation by the second ejection pulse P2.

As above, in the outlet 241 where the output value indicating to form a dot is inputted to its element driving circuit 231, the ejection operation by the first ejection pulse P1 and the ejection operation by the second ejection pulse P2 are performed continuously in a short time, in response to one driving signal. Therefore, the first main dot element 611, the first satellite dot element, the second main dot element 621 and the second satellite dot element 622 are formed on the recording paper 9 and a set of these dot elements becomes one dot corresponding to the one driving signal.

Figure 8:
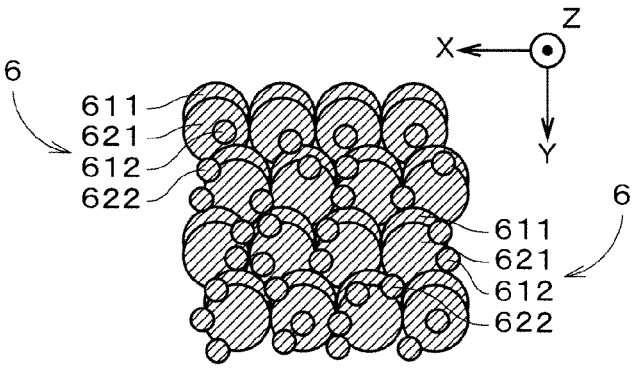
FIG. 8 is a view showing a plurality of dots formed on a recording paper.

FIG. 8 is a view showing a plurality of dots 6 formed on the recording paper 9. In FIG. 8, each of the first main dot elements 611 the first satellite dot elements 612, the second main dot elements 621 and the second satellite dot elements 622 is shown by a circle with solid line in which hatching lines are drawn. In FIG. 8, the first and second satellite dot elements 612, 622 are drawn so as to lie on the first and second main dot elements 611, 621 for the convenience of illustration. As described above, in each portion where these dot elements 611, 612, 621, 622 are overlapped with each other, an outer edge of each dot element is not clear in fact.

In the inkjet printer 1, the ejection control of ink is performed alternately to the outlet row 251 and the outlet row 252 in FIG. 2. Thus, in the plurality of dots 6 formed on the recording paper 9, as shown in FIG. 8, positions of dots 6 in the width direction (X direction) which are formed by the outlet row 251 are different from positions of dots 6 formed by the outlet row 252.

After a whole image shown in the original image data which is a target of recording is recorded on the recording paper 9 by the above way, movement of the recording paper 9 is stopped and the image recording operation by the inkjet printer 1 is completed (Step S13 of FIG. 5).

Figure 9:
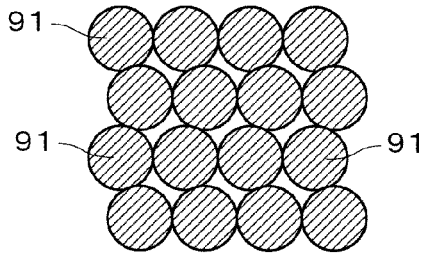
FIG. 9 is a view showing a plurality of dots in accordance with a comparative example.

Here, discussion will be made on a comparative example of image recording operation in an inkjet printer. In the comparative example of image recording operation where two main droplets ejected by two continuous ejection pulses are merged during their flight and a landing position of satellite droplet is aligned to a landing position of main droplet, as shown in FIG. 9, dots 91 each having an almost circular shape are arranged regularly. Thus, in the case where an area with relatively high gray levels such as a uniform area with the maximum gray level (i.e., the area is a solid area of ink) is represented by these dots 91, an edge of the area becomes jaggy state (zigzag) so that contrast in the vicinity of the edge decreases or a density of the area (or an area ratio of portions to which ink adheres to portions to which ink doesn't adhere) becomes lower due to existence of gaps between dots 91.

Correspondingly, in the inkjet printer 1, in the outlet 241 where the output value indicating to form a dot is inputted to its element driving circuit 231, the plurality of droplets are ejected by input of one driving signal and these droplets land onto positions on the recording paper 9 which are close to one another. Therefore, the shape of dot can be made noncircular (that is to change the dot shape from a circle by providing the circular main dot element of one main droplet with the circular dot element(s) of the other droplet(s), and that can be treated as to make the dot shape to be slightly out-of-focus). As the result, it is possible to suppress (reduce) jaggies on edges of an image on the recording paper 9 and lowering of density in a solid area. In the case where density unevenness (mura) or the like occurs, unevenness can be reduced since portions having low density are compensated by out-of-focus dots.

Figure 10:
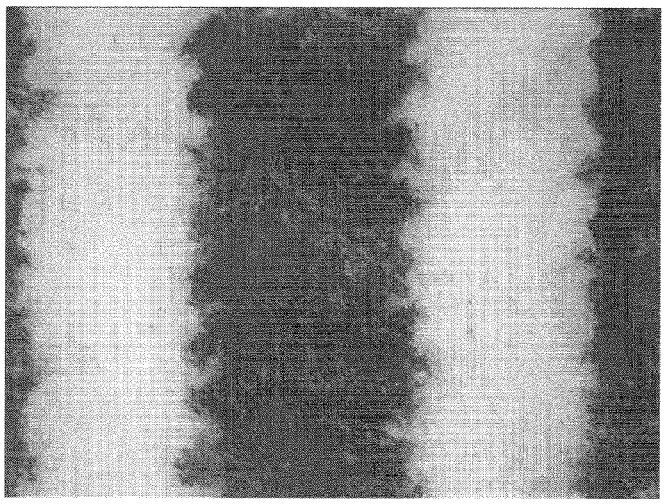
FIG. 10 is a picture showing a barcode image in accordance with the comparative example.
Figure 11:
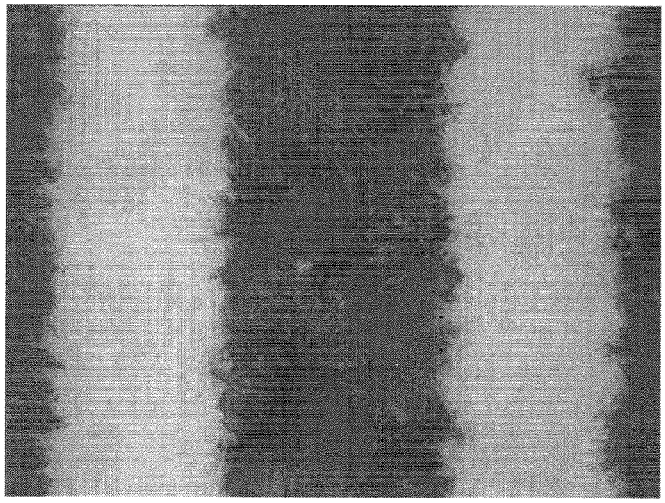
FIG. 11 is a picture showing a barcode image recorded on the recording paper.

FIGS. 10 and 11 are pictures showing barcode images recorded on the recording papers 9. In FIGS. 10 and 11, barcodes where a plurality of bars each elongated in the scanning direction are arranged in the width direction are recorded (the barcodes are also called as "pikes"). FIG. 10 shows the barcode recorded by image recording operation in accordance with the comparative example where shapes of dots become circular, and FIG. 11 shows the barcode recorded by the inkjet printer 1 where shapes of dots become noncircular. It can be seen that jaggies on edges of black bars in FIG. 11 are moderated in comparison with those of black bars in FIG. 10 and contrast in the vicinities of the edges is improved in FIG. 11. Thus, a quality grade of the barcode in FIG. 11 becomes better in comparison to that of the barcode in FIG. 10.

Although an image density, measured with a predetermined densitometer, of a solid area recorded by the image recording operation of the comparative example is 1.18, an image density of a solid area recorded by the inkjet printer 1 increases to 1.23. Therefore, density unevenness in the solid area is also improved. In the inkjet printer 1, since jaggies on edges of characters or the like in the recorded image are also suppressed, quality of image on the recording paper 9 becomes better.

In the meantime, with respect to ejection of main droplets by the first and second ejection pulses P1, P2, if the average distance from the center C11 of the first main dot element 611 shown in FIG. 6 to the farthest point al in the group of dot elements becomes less than 1.1 times the average radius of the first main dot element 611, a shape of dot formed by these main droplets remains almost circular. Thus, it is preferable that the average distance is equal to or more than 1.1 times the average radius of the first main dot element 611. On the other hand, if the average distance from the center C11 of the first main dot element 611 to the farthest point al in the group of dot elements becomes more than 3.0 times the average radius of the first main dot element 611, the first main dot element 611 and the second main dot element 621 are separated from each other. Thus, it is preferable that the average distance is equal to or less than 3.0 times the average radius of the first main dot element 611. In addition, from the viewpoint of preventing thin lines in an image from dilating, it is more preferable that the average distance is equal to or less than 2.0 times the average radius.

With respect to ejection of a main droplet and a satellite droplet by the second ejection pulse P2 (or first ejection pulse P1), if the average distance from the center C21 of the second main dot element 621 shown in FIG. 7 to the farthest point α2 in the group of dot elements becomes less than 1.1 times the average radius of the second main dot element 621, a shape of dot formed by the main droplet and the satellite droplet remains almost circular. Thus, it is preferable that the average distance is equal to or more than 1.1 times the average radius of the second main dot element 621. On the other hand, if the average distance from the center C21 of the second main dot element 621 to the farthest point α2 in the group of dot elements becomes more than 3.0 times the average radius of the second main dot element 621, it seems that the second satellite dot element 622 doesn't lie in the vicinity of the outer edge of the second main dot element 621. In other words, the second satellite dot element 622 is not regarded as a concomitant (satellite) of the second main dot element 621. Thus, it is preferable that the average distance is equal to or less than 3.0 times the average radius of the second main dot element 621. In addition, from the viewpoint of preventing thin lines in an image from dilating, it is more preferable that the average distance is equal to or less than 2.0 times the average radius.

In ejection operation by each ejection pulse P1, P2, a plurality of satellite droplets may be ejected with a main droplet, as long as, in a group of dot elements formed by droplets ejected in same ejection step, an average distance from the center of a main dot element to the farthest point is equal to or more than 1.1 times an average radius of the main dot element and equal to or less than 3.0 times the average radius. For example, in the case where two (or more) second satellite droplets are ejected with a second main droplet, a second satellite dot element shown by a circle with a chain double-dashed line denoted by a reference sign 622*a* in FIG. 7 is formed on the recording paper 9 with the second main dot element 621 and the second satellite dot element 622 shown in FIG. 7. In this case, the driving signal is adjusted in the inkjet printer 1 so that an average distance from the center C21 of the second main dot element 621 to the farthest point (the point α2 in the example of FIG. 7) in a group of dot elements which is a set of the second main dot element 621 and two second satellite dot elements 622, 622*a* is equal to or more than 1.1 times the average radius of the second main dot element 621 and equal to or less than 3.0 times the average radius.

Figure 12:
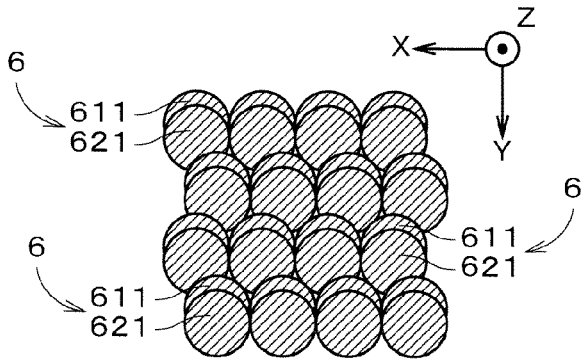
FIG. 12 is a view showing a plurality of dots formed on a recording paper.

In the above operation example of the inkjet printer 1, as shown in FIG. 8, each dot 6 is formed by the first main dot element 611, the first satellite dot element 612, the second main dot element 621 and the second satellite dot element 622, however as shown in FIG. 12, each dot 6 may be formed by only the first main dot element 611 and the second main dot element 621. Also in this case, since an average distance from the center of the first main dot element 611 to the farthest point in a group of dot elements (i.e., a set of first and second main dot element 611, 621) is made equal to or more than 1.1 times an average radius of the first main dot element 611 and equal to or less than 3.0 times the average radius, it is possible to suppress jaggies on edges of an image on the recording paper 9 and lowering of density in a solid area in comparison to the comparative example of FIG. 9. In the example of FIG. 12, a satellite droplet(s) with one main droplet is merged into the main droplet during their flight to land on the recording paper 9 as one droplet or a satellite droplet(s) is not generated in principle.

Figure 13:
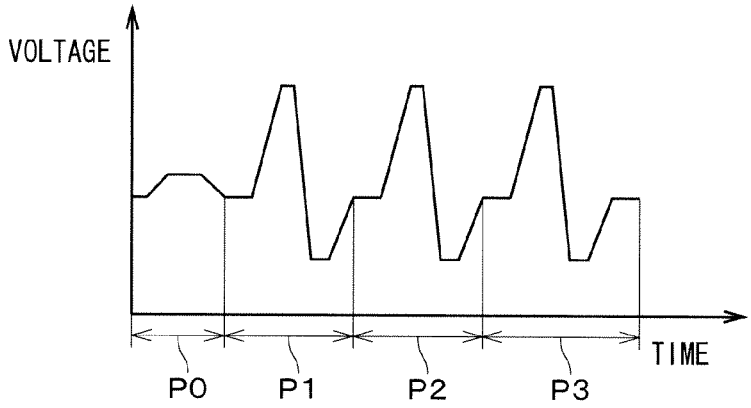
FIG. 13 is a view showing another example of driving signal.

In addition, as shown in FIG. 13, a driving signal having a non-ejection pulse P0 and first to third ejection pulses P1, P2, P3 may be utilized. In this case, in first to third main droplets ejected from an outlet 241 by using the first to third ejection pulses P1 to P3, each of a relationship between the first and second main droplets, and a relationship between the second and third main droplets is the same as the relationship between the first and second main droplets in the above description with reference to FIG. 6. It is therefore possible to further suppress jaggies on edges of an image on the recording paper 9 and lowering of density in a solid area.

As above, in the inkjet printer 1, a leading droplet which is a main droplet is ejected from an outlet 241 by one ejection pulse included in each driving signal, a following droplet which is a main droplet is ejected from the outlet 241 by the next ejection pulse (i.e., an ejection pulse following the one ejection pulse) in the each driving signal, and the leading droplet and the following droplet individually (in the state where they are separated) land onto the recording paper 9. And an average distance from the center of a leading dot element formed on the recording paper 9 by the leading droplet to the farthest point in a group of dot elements formed by the leading droplet and the following droplet is made equal to or more than 1.1 times an average radius of the leading dot element and equal to or less than 3.0 times the average radius. Therefore, the dot shape is made noncircular by droplets based on the two continuous ejection pulses, and it is possible to suppress jaggies on edges of an image on the recording paper 9 and lowering of density in a solid area.

In the case where one dot is formed by three or more main dot elements, it is preferable that an average distance from the center of a leading dot element formed by a main droplet, which is the first to land onto the recording paper 9, to the farthest point in a group of dot elements formed by all main droplets (or all main droplets and all satellite droplets) ejected by the same driving signal as the main droplet is equal to or more than 1.1 times an average radius of the leading dot element and equal to or less than 3.0 times the average radius, for the purpose of preventing excessive influence by the dot to the adjacent pixel (which is adjacent to the pixel of the dot).

Figure 14:
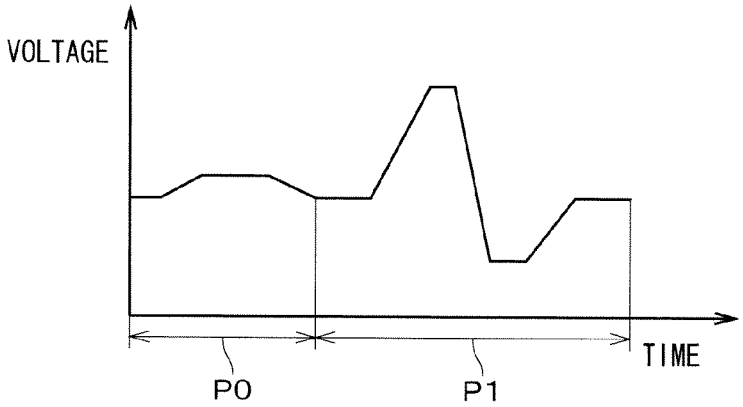
FIG. 14 is a view showing still another example of driving signal.

In addition, as shown in FIG. 14, a driving signal having only the non-ejection pulse P0 and the first ejection pulse P1 may be used. In this case, the waveform of driving signal is set such that only a first main droplet and a first satellite droplet are ejected by inputting one driving signal and such that an average distance from the center of a first main dot element to the farthest point in a group of dot elements, where a set of the first main dot element and the first satellite dot element is regarded as the group of dot elements, becomes equal to or more than 1.1 times an average radius of the first main dot element and equal to or less than 10 times the average radius. Therefore, the dot shape can be made noncircular, and it is possible to suppress jaggies on edges of an image on the recording paper 9 and lowering of density in a solid area in comparison to the comparative example of FIG. 9.

Figure 15:
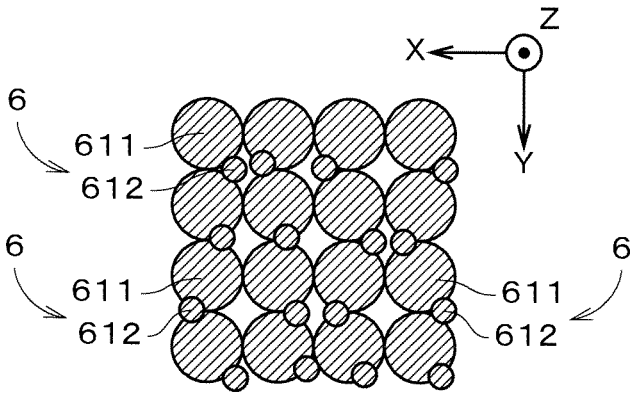
FIG. 15 is a view showing a plurality of dots formed on a recording paper.
Figure 16:
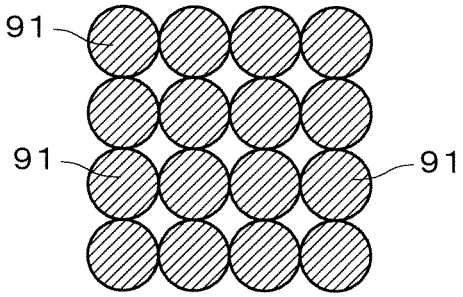
FIG. 16 is a view showing a plurality of dots in accordance with a comparative example.

Furthermore, as shown in FIG. 15, in an inkjet printer where a plurality of dots 6 are formed so that their positions in the width direction (the X direction) are constant, the above technique where the dot shape is made noncircular may be utilized. In FIG. 15, one dot 6 consists of one main dot element 611 and one satellite dot element 612. In this case, it is possible to suppress jaggies on edges of an image on the recording paper 9 and lowering of density in a solid area in comparison to a comparative example of FIG. 16 where circular dots 91 are formed.

As above, in the inkjet printer, a leading droplet which is a main droplet and a following droplet(s) which is a satellite droplet(s) associated with (accompanying) the main droplet are ejected from an outlet 241 by an ejection pulse included in each driving signal, and the leading droplet and the following droplet(s) land onto the recording paper 9 individually (as individual droplets). And an average distance from the center of a leading dot element formed on the recording paper 9 by the leading droplet to the farthest point in a group of dot elements formed on the recording paper 9 by the leading droplet and the following droplet(s) is made equal to or more than 1.1 times an average radius of the leading dot element and equal to or less than 3.0 times the average radius. Therefore, the dot shape can be made noncircular by the main droplet and the satellite droplet(s) (actually, the dot shape can be irregularly varied from a circle). As the result, it is possible to suppress bumps on edges of an image on the recording paper 9 and lowering of optical density in a solid area. Even if a circular satellite dot element(s) formed by a satellite droplet(s) is not overlapped with a circular main dot element formed by a main droplet at all, a shape of a dot which is a set of these dot elements is regarded as a noncircular shape.

The inkjet printer 1 may be able to form a plurality of dots having different sizes on the recording paper 9 by ejecting different amounts of ink from each outlet 241 toward the recording paper 9. In this case, the above technique where the dot shape is made noncircular may be utilized for only one (or some) size of dot. For example, an ejection pulse for forming a small dot having smaller size (area) than dots 6 in FIG. 8 is added to the driving signal in FIG. 4 as a third ejection pulse. And when the output value from the head controller 44 indicates the small dot, the third ejection pulse is applied for driving of the piezoelectric element 232. Only a main droplet is ejected or a satellite droplet(s) associated with the main droplet is merged into the main droplet during their flight to land as one droplet, and therefore the small dot is formed. In an area where high recording resolution is required, a fine image is represented with the small dots. In addition, in an area whose density (image density) is high or the like, the first and second ejection pulses P1, P2 are applied to form dots shown in FIG. 8 which are dots having the maximum size.

As above, in the inkjet printer 1, the leading droplet and the following droplet(s) (i.e two main droplets ejected continuously, or a main droplet and a satellite droplet(s) associated with the main droplet) are ejected from an outlet 241 to land onto the recording paper 9 respectively, when a dot having the maximum size is formed. Therefore, the dot shape is made noncircular, and lowering of density in a solid area on the recording paper 9 and jaggies on edges in the solid area can be suppressed.

When only medium sized dots (medium dots) and large sized dots are used for image recording, there is a case where the medium dots are used for representing (recording) the maximum gray level area. In this case, when forming the medium dot, the noncircular dot may be formed by ejecting a leading droplet and a following droplet(s) from an outlet 241 to land onto the recording paper 9 individually. All sizes of dots may be noncircular. As described above, in the inkjet printer which can form at least one size of dot, the above technique may be used so that a shape of a dot having arbitrary size out of the at least one size is made noncircular.

Next, discussion will be made on another example of inkjet printer 1. In the inkjet printer 1 in accordance with the another example, another type of driving signal (hereinafter, referred to as the "second driving signal") which has a different waveform from the driving signal shown in FIG. 4 (hereinafter, the driving signal is referred to as the "first driving signal") is prepared. In the case where the second driving signal is inputted to the head part 23, when the output value indicates to form a dot, a leading droplet and a following droplet(s) (i.e., two main droplets ejected continuously, or a main droplet and a satellite droplet(s) associated with the main droplet) are ejected from an outlet 241 and an average distance from the center of a leading dot element formed by the leading droplet to the farthest point in a group of dot elements formed by the leading droplet and the following droplet(s) becomes less than 1.1 times an average radius of the leading dot element. Or, when the output value indicates to form a dot, only one droplet is ejected from the outlet 241. Therefore, an almost circular dot is formed.

In the inkjet printer 1, the first driving signal or the second driving signal is selected by an operator through an input part of the computer 5. In actual image recording, droplets are ejected from the outlets 241 on the basis of the selected driving signal. As above, since the first driving signal or the second driving signal can be selectively (selectably) inputted to the head part, it is possible to select whether to change the dot shape or not (from a circle) in accordance with application and to achieve various image recording.

In the inkjet printer 1, when the second driving signal is inputted to the head part 23, there may be a case where a leading droplet and a following droplet(s) are ejected from an outlet 241 and an average distance from the center of a leading dot element formed by the leading droplet to the farthest point in a group of dot elements formed by the leading droplet and the following droplet(s) is different from the average distance in the case of the first driving signals (in the above example described with reference to FIGS. 6 and 7, the average distance is almost 1.5 times the average radius of the leading dot element), while staying within a range which is equal to or more than 1.1 times an average radius of the leading dot element and equal to or less than 3.0 times the average radius. Therefore, in the inkjet printer 1 where the driving signal applied for actual image recording is selectable, it is possible to select a degree of change of the dot shape in accordance with application.

Though the preferred embodiments of the present invention have been discussed above, the present invention is not limited to the above-discussed preferred embodiments, but allows various variations.

In the operation example described with reference to FIG. 8, the first main droplet and the first satellite droplet(s) are ejected by the first ejection pulse P1, and the second main droplet and the second satellite droplet(s) are ejected by the second ejection pulse P2. However, for example, there may be a case where, by the first ejection pulse P1, only the first main droplet is ejected, or the first main droplet and the first satellite droplet(s) to be merged with each other to land onto the recording paper 9 are ejected, and by the second ejection pulse P2, the second main droplet and the second satellite droplet(s) to individually land onto the recording paper 9 are ejected. That is, in the case where a leading main droplet is ejected from an outlet 241 by one ejection pulse included in each driving signal and a following main droplet is ejected from the outlet 241 by the next ejection pulse (the ejection pulse following the one ejection pulse) in the each driving signal, it is preferable that a main droplet and a satellite droplet(s) associated with the main droplet which are to individually land onto the recording paper 9 are ejected in at least one of ejection of the leading main droplet and ejection of the following main droplet.

Although the recording paper 9 is moved relative to the head part 23 in the scanning direction by the paper feeder 3 which is a scanning mechanism in the inkjet printer 1, a scanning mechanism for moving the head part 23 in the Y direction may be provided. There also may be a case where the recording paper 9 is held on a roller and the recording paper 9 is moved relative to the head part 23 in the scanning direction by a motor rotating the roller. As above, a scanning mechanism for moving the recording paper 9 in the scanning direction relative to the head part 23 can be implemented by various structures.

The inkjet printer may be a machine for recording an image on a recording paper which is a cut sheet. For example, in an inkjet printer where a recording paper is held on a stage, with respect to a width direction, a width within which a plurality of outlet in a head part are arranged is narrower than a width of a recording area of the recording paper, and a scanning mechanism for moving the head part relative to the recording paper in a scanning direction and the width direction is provided. The head part performs relative movement (main scanning) in the scanning direction while ejecting ink, and after arrival at an end of the recording paper, the head part performs relative movement (sub scanning) in the width direction by a predetermined distance. After that, the head part performs relative movement toward a side in the scanning direction, which is different from the side in the last main scanning, while ejecting ink. Thus, in the above inkjet printer, the head part performs the main scanning relative to the recording papers in the scanning direction, and intermittently performs the sub scanning in the width direction every time when the main scanning is completed, thereby to print an image on the whole recording paper.

An object in image recording by the inkjet printer 1 may be a plate-like or film-like base member formed of a material such as plastic or the like other than the recording paper 9.

The constituent elements of above-discussed preferred embodiments and respective modified examples may be appropriately combined with one another, as long as they are not mutually exclusive.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2010-110124 filed in the Japan Patent Office on May 12, 2010, the entire disclosure of which is incorporated herein by reference.

REFERENCE SIGNS LIST

1 inkjet printer
3 paper feeder
4 main body controller
6 dot
9 recording paper
23 head part
241 outlet
611, 612, 621, 622, 622*a* dot element
C11, C21 center (of dot element)
P1 to P3 ejection pulse
S11 to S13 step
$\alpha$1, $\alpha$2 farthest point (from center)

The invention claimed is:

1. An inkjet printer, comprising:

a head part for ejecting droplets of ink from a plurality of outlets toward an object and including piezoelectric elements provided for respective outlets of the plurality of outlets;

a scanning mechanism for moving said object in a predetermined scanning direction relative to said head part; and a controller for repeatedly inputting an output value and a driving signal to said head part to form a solid area having an edge on said object, said output value and said driving signal being input in parallel with relative movement of said object to said head part, said output value indicating whether to form a dot or not, and said driving signal being applied for ejection of droplet; wherein the driving signal includes a plurality of ejection pulses each operative to make a respective one of the piezoelectric elements perform a series of operations, a leading droplet and a following droplet are ejected from an outlet by inputting said output value indicating to form a dot and said driving signal, wherein said leading droplet is a main droplet ejected by an ejection pulse included in said driving signal and said following droplet is a main droplet ejected by the next ejection pulse in said driving signal, and said leading droplet and said following droplet land onto said object, an average distance from the center of a leading dot element formed on said object by said leading droplet to the farthest point in a group of dot elements formed on said object by said leading droplet and said following droplet to form the solid area is equal to or more than 1.1 times an average radius of said leading dot element and equal to or less than 3.0 times said average radius, said leading dot element and a dot element formed by said following droplet partially overlap with each other, and said leading dot element and said dot element formed by said following droplet are included in a dot corresponding to a pixel, another type of driving signal having a waveform different from said driving signal can be selectively inputted to said head part, said another type of driving signal including a plurality of ejection pulses, and in the case where said another type of driving signal is inputted to said head part:

said leading droplet and said following droplet are ejected from said outlet so that an average distance from the center of said leading dot element by said leading droplet to the farthest point in said group of dot elements by said leading droplet and said following droplet is less than 1.1 times an average radius of said leading dot element, or said average distance in the case of said another type of driving signal is different from said average distance in the case of said driving signal, while staying within a range which is equal to or more than 1.1 times an average radius of said leading dot element and equal to or less than 3.0 times said average radius.

2. The inkjet printer according to claim 1, wherein a plurality of dots having different sizes can be formed on said object by ejecting droplets of ink from said outlet toward said object, said leading droplet and said following droplet are ejected from said outlet by inputting said driving signal when a dot having the maximum size or a dot used for representing the maximum gray level area is formed.

3. The inkjet printer according to claim 1, wherein said driving signal includes first, second, and third ejection pulses operative to cause the ejection of first, second, and third main droplets, respectively, and an average distance relationship between the first and second main droplets and an average distance relationship between the second and third main droplets each are the same as the average distance relationship between the leading droplet and the following droplet where the average distance from the center of the leading dot element formed by the leading droplet to the farthest point in the group of dot elements formed by the leading droplet and the following droplet is equal to or more than 1.1 times the average radius of the leading dot element and equal to or less than 3.0 times the average radius.

4. An image recording method performed in an inkjet printer, wherein said inkjet printer comprises a head part for ejecting droplets of ink from a plurality of outlets toward an object, the head part including piezoelectric elements provided for respective outlets of the plurality of outlets, said image recording method comprising the steps of:

a) moving said object in a predetermined scanning direction relative to said head part; and b) repeatedly inputting an output value and a driving signal to said head part to form a solid area having an edge on said object, said output value and said driving signal being input in parallel with said step a), said output value indicating whether to form a dot or not, and said driving signal being applied for ejection of droplet; wherein the driving signal includes a plurality of ejection pulses each operative to make a respective one of the piezoelectric elements perform a series of operations, a leading droplet and a following droplet are ejected from an outlet by inputting said output value indicating to form a dot and said driving signal, wherein said leading droplet is a main droplet ejected by an ejection pulse included in said driving signal and said following droplet is a main droplet ejected by the next ejection pulse in said driving signal, and said leading droplet and said following droplet land onto said object, and an average distance from the center of a leading dot element formed on said object by said leading droplet to the farthest point in a group of dot elements formed on said object by said leading droplet and said following droplet to form the solid area is equal to or more than 1.1 times an average radius of said leading dot element and equal to or less than 3.0 times said average radius, said leading dot element and a dot element formed by said following droplet partially overlap with each other, and said leading dot element and said dot element formed by said following droplet are included in a dot corresponding to a pixel, another type of driving signal having a waveform different from said driving signal can be selectively inputted to said head part, said another type of driving signal including a plurality of ejection pulses, and in the case where said another type of driving signal is inputted to said head part:

said leading droplet and said following droplet are ejected from said outlet so that an average distance from the center of said leading dot element by said leading droplet to the farthest point in said group of dot elements by said leading droplet and said following droplet is less than 1.1 times an average radius of said leading dot element, or said average distance in the case of said another type of driving signal is different from said average distance in the case of said driving signal, while staying within a range which is equal to or more than 1.1 times an average radius of said leading dot element and equal to or less than 3.0 times said average radius.

5. The image recording method according to claim 4, wherein a plurality of dots having different sizes can be formed on said object by ejecting droplets of ink from said outlet toward said object, said leading droplet and said following droplet are ejected from said outlet by inputting said driving signal when a dot having the maximum size or a dot used for representing the maximum gray level area is formed.

6. The image recording method according to claim 4, wherein said driving signal includes first, second, and third ejection pulses operative to cause the ejection of first, second, and third main droplets, respectively, and an average distance relationship between the first and second main droplets and an average distance relationship between the second and third main droplets each are the same as the average distance relationship between the leading droplet and the following droplet where the average distance from the center of the leading dot element formed by the leading droplet to the farthest point in the group of dot elements formed by the leading droplet and the following droplet is equal to or more than 1.1 times the average radius of the leading dot element and equal to or less than 3.0 times the average radius.

* * * * *